United States Patent [19]

Crooks

[11] 4,068,987

[45] Jan. 17, 1978

[54] PNEUMATIC MOTOR WITH MUFFLED EXHAUST

[75] Inventor: Fuller A. Crooks, Huntington Beach, Calif.

[73] Assignee: Elmer A. Selzer, Huntington Beach, Calif.

[21] Appl. No.: 708,275

[22] Filed: July 23, 1976

[51] Int. Cl.[2] ..... F01C 13/02; F01C 21/00

[52] U.S. Cl. ..... 418/181; 418/270; 181/230

[58] Field of Search ..... 418/181, 270; 173/163, 173/169, DIG. 2; 181/36 A

[56] References Cited

U.S. PATENT DOCUMENTS

| | | | |
|---|---|---|---|
| 1,979,537 | 11/1934 | Elliott | 418/181 |
| 3,129,642 | 4/1964 | Sorensen et al. | 173/163 |
| 3,459,275 | 8/1969 | Prillwitz et al. | 418/181 |

FOREIGN PATENT DOCUMENTS

| | | | |
|---|---|---|---|
| 1,115,165 | 5/1968 | United Kingdom | 418/270 |

*Primary Examiner*—John J. Vrablik

*Attorney, Agent, or Firm*—William W. Haefliger

[57] ABSTRACT

In a pneumatic motor that includes a vaned rotor, a rotor chamber having a gas inlet and gas outlet means, a housing and an axially extending rotor shaft to rotate in said chamber, structure to control and muffle the escape of exhaust gas comprising a. a first exhaust chamber extending about the rotor chamber and into which pressurized exhaust gas escapes from the rotor chamber, b. a second exhaust chamber spaced axially from the first exhaust chamber and extending about the shaft, and primary porting communicating between the first and second exhaust chambers, and c. a third exhaust chamber extending about the shaft and located radially inwardly of the second exhaust chamber, there being radially inwardly extending porting spaced about the shaft and communicating between the second and third exhaust chambers to direct escaping exhaust directionally inwardly and in conflicting turbulent streams to dissipate energy contained in said streams.

7 Claims, 4 Drawing Figures

PNEUMATIC MOTOR WITH MUFFLED EXHAUST

BACKGROUND OF THE INVENTION

This invention relates generally to noise attenuation, and more specifically to means for minimizing the intensity of sound produced in the exhaust system of an air pressure operated motor, commonly referred to as a pneumatic motor.

The noise from a pneumatic motor is caused by the flow of high velocity air under pressure, and containing high impulses created by the sudden opening and closing of the exhaust ports in the cylinder in which the rotor revolves. While many efforts have been made to attenuate such impulses, none of them so far as I am aware has embodied the unusual advantages in structure, mode of operation and results as are now afforded by the present invention. Among these are the advantages of extreme compactness, simplicity, high attenuation and control of exhaust escape flow, as will be seen.

SUMMARY OF THE INVENTION

It is a major object of the invention to overcome the problem of prior pneumatic motor exhaust attenuation devices, and to provide the advantages as referred to above. Basically, the exhaust muffling or attenuating system is embodied in a pneumatic motor that includes a vaned rotor, a rotor chamber having a gas inlet and outlet means, a housing and an axially extending rotor shaft, and includes:

a. a first exhaust chamber extending about the rotor chamber and into which pressurized exhaust gas escapes from the rotor chamber, b. a second exhaust chamber spaced axially from the first exhaust chamber and extending about the shaft, and primary porting communicating between the first and second exhaust chambers, and c. a third exhaust chamber extending about the shaft and located radially inwardly of the second exhaust chamber, there being radially inwardly extending porting spaced about the shaft and communicating between the second and third exhaust chambers to direct escaping exhaust directionally inwardly and in conflicting turbulent streams to dissipate energy contained in said streams.

As will be seen, additional exhaust gas escape porting may be provided to extend generally axially from the third chamber, and a sleeve may be adjustably supported on the housing for axial displacement in controlling relation with the additional porting to control the escape of exhaust gas and the motor speed; further, the second exhaust chamber may also function as a plenum to equalize distribution of pressurized gas received from the first chamber which may have varying radial dimension about the rotor axis; and axially spaced slots that communicate between the rotor chamber interior and the first exhaust chamber may have relieved leading edges adjacent the rotor chamber to produce a gradual escaping gas pulse pressure rise as each vane passes over such edges, for reducing the pulse intensities.

These and other objects and advantages of the invention, as well as the details of an illustrative embodiment, will be more fully understood from the following description and drawings, in which:

DRAWING DESCRIPTION

DETAILED DESCRIPTION

Figure 1:
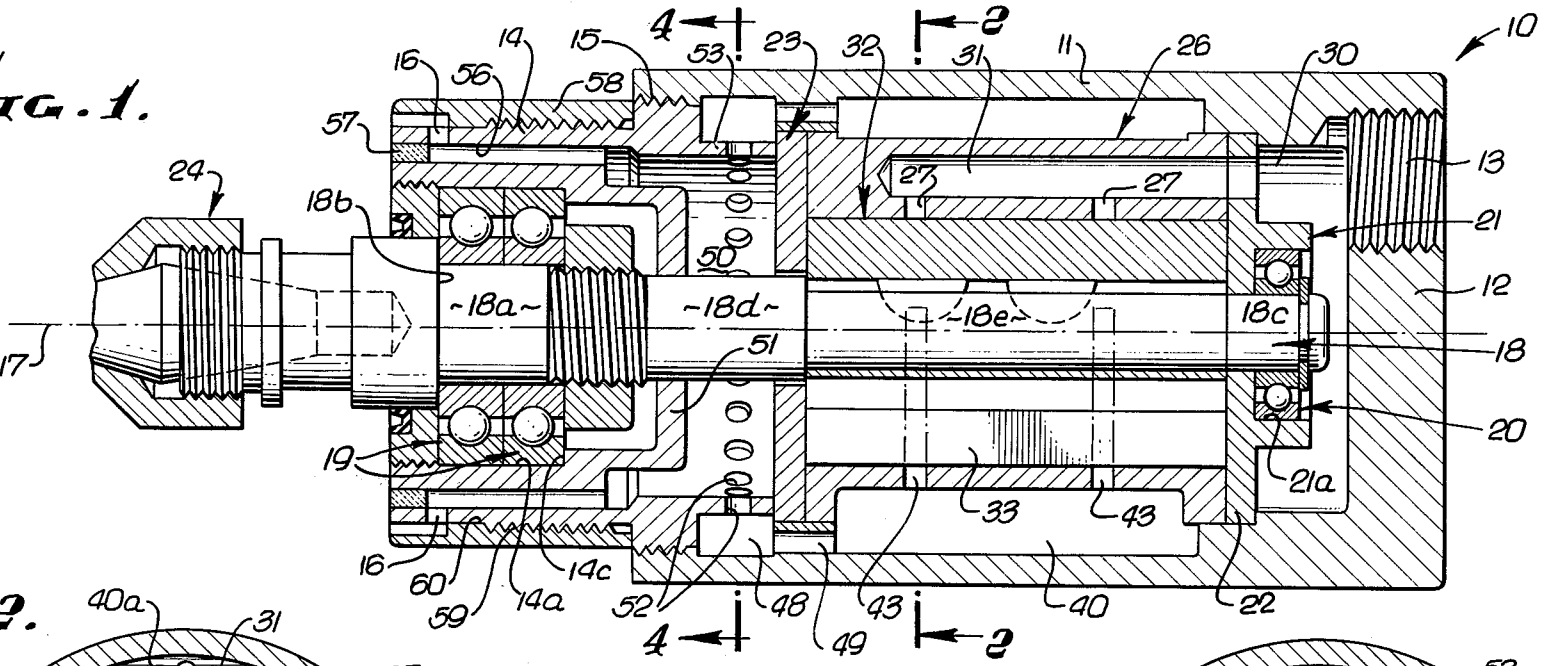
FIG. 1 is a vertical axial section, in elevation, through a motor embodying the invention.
Figure 4:
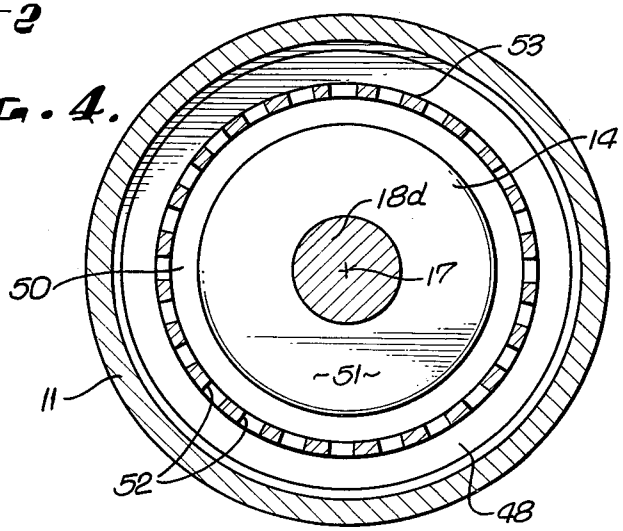
FIG. 4 is a section on lines 4—4 of FIG. 1.

In the drawings, a housing 10 is defined by annular body 11 having an end wall 12 defining an air or gas inlet 13. A tubular body extension 14 has thread connection at 15 to body 11, and defines air or gas outlets 16 which are circularly spaced about the axis 17 of shaft 18. Rotor shaft 18 extends rightwardly through extension 14, into body 11 and terminates in spaced relation to wall 12. Anti-friction bearing assemblies 19 are received within a bore **14*a* in extension 14, extend about the shaft left section 18*a* in supporting relation, and are confined between shoulders 18*b* and 14*c*. Anti-friction bearing assembly 20 is located within a bore 21*a* in annular disc 21, and extends about the shaft right end section 18*c*. Disc 21 is in turn shouldered at 22 in the body, in axially spaced relation to a second annular disc 23, the latter extending about the shaft mid-section 18*d*. The left protruding end of the shaft may carry or rotatably drive any appropriate tool or apparatus generally indicated at 24**.

Figure 2:
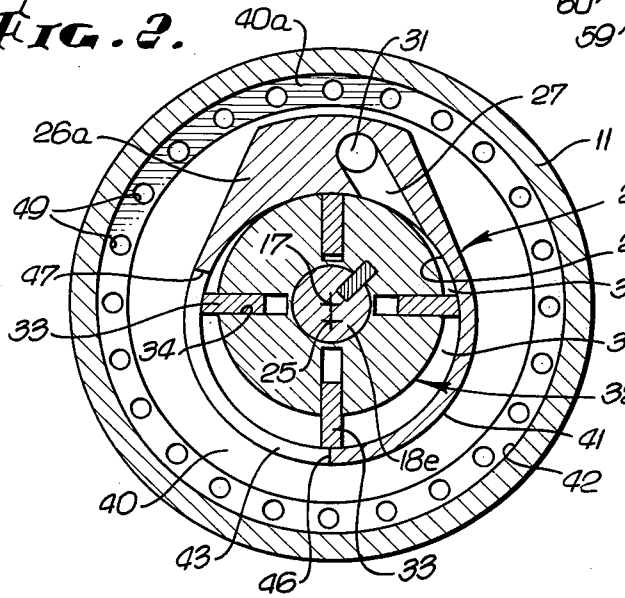
FIG. 2 is a section, in elevation, on lines 2—2 of FIG. 1.

Retained between discs or plates 21 and 23 is a rotor chamber 26 which is generally annular. The chamber axis 25 is parallel to shaft axis 17, but is eccentric thereto, as seen in FIG. 2. Chamber 26 defines a pressurized gas as air inlet shown for example in the form of two inlet ports 27 which extend to the chamber bore 28, and to which air or gas is supplied via inlet 13, plenum 30 between disc 21 and wall 12, and axial port 31 in the chamber enlargement **26*a*. A rotor 32 is mounted on the shaft extent 18*e* and carries radially and axially extending vanes 33 in corresponding slots 34 in the rotor, the vanes being slidable radially in the slots and urged by centrifugal force against the bore 28. Pressurized air or gas forces the vanes and rotor to rotate clockwise in FIG. 2, the air or gas expanding in the spaces indicated at 35 and 36 as the rotor turns, due to the eccentric relation of axis 17 and 25**.

In accordance with the invention, a first exhaust chamber is provided to extend about the rotor chamber to receive pressurized, expanding exhaust gas escaping from the rotor chamber.

In the example, the first exhaust chamber 40 has internal, inner and outer walls 41 and 42, with radial spacing therebetween which varies about the rotor chamber, that spacing being a minimum at first exhaust chamber section **40*a*. Two axially spaced, angularly extending, radial slots 43 in the rotor chamber wall communicate between the rotor chamber interior and the first exhaust chamber, whereby as the vanes rotate, exhaust gas pressure is released through such ports to exhaust chamber 40. The angular extent of ports 43 is about 90°, as shown, between leading and trailing edges 46 and 47**.

A second exhaust chamber 48 is spaced axially from the first chamber 40, and extends about the rotor shaft 18, there being primary porting 49 communicating between the two exhaust chambers 40 and 48. In the example, the porting 49 comprises a large number of axially extending ports, circularly spaced about the axis 17 to directly communicate all portions of chamber 40 having different radial dimension with all portions of annular chamber 48, the latter acting as a plenum. Also, chamber 48 turns the exhaust flow radially inwardly, with benefits to be described, in addition to attenuating the exhaust stream and equalizing the pressure of the exhaust escaping from the chamber 40.

A third exhaust chamber 50 is also provided to extend directly about the shaft section 18*d* and between plate or disc 23 and end wall 51 of body extension 14. Annular chamber 50 is located radially inwardly of the second exhaust chamber, there being radially inwardly extending porting or ports 52 in body extension projection 53 spaced about the shaft to communicate between chambers 48 and 50. Ports 52 direct the escaping exhaust directionally inwardly and in conflicting turbulent streams to dissipate energy contained in such streams.

Additional exhaust porting is provided in the form of radially outwardly extending ports 16 spaced about axis 17 and located in axially spaced relation to chamber 50. Such ports are formed in the cylindrical wall of body extension 14, and communicate with that chamber as via axial passages 56, plugged at 57. A sleeve 58 is supported on the housing extension 14 for axial displacement in progressively controlling relation with the ports 16, to control the escape of exhaust gap, as well as the speed of the motor (by control of back pressure). Sleeve 58 has threaded connection at 59 to the body extension, and may be rotated to move axially, to cause sleeve annular land 60 to progressively cover or uncover the ports 16.

Figure 3:
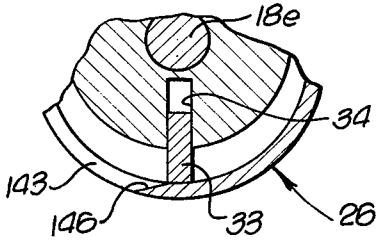
FIG. 3 is a fragmentary section.

Finally, FIG. 3 shows modified rotor chamber slots 143 (corresponding to slots 43 in FIG. 2) having relieved leading edges 146 adjacent the rotor interior, to produce a gradual (instead of sudden) escaping gas pulse pressure rise as each vane passes over such edges.

I claim:

1. In a pneumatic motor that includes a vaned rotor, a rotor chamber having a gas inlet and gas outlet means, a housing and an axially extending rotor shaft to rotate in said chamber, structure to control and muffle the escape of exhaust gas comprising a. a first exhaust chamber extending about the rotor chamber and into which pressurized exhaust gas escapes from the rotor chamber, b. a second exhaust chamber spaced axially from the first exhaust chamber and extending about the shaft, and primary porting communicating between the first and second exhaust chambers, said primary porting including multiple flow restricting ports circularly spaced about said shaft and spaced radially outwardly therefrom, c. a third exhaust chamber extending about the shaft and located radially inwardly of the second exhaust chamber, there being radially inwardly extending porting spaced about the shaft and communicating between the second and third exhaust chambers to direct escaping exhaust directionally inwardly and in conflicting turbulent streams to dissipate energy contained in said streams, d. there being additional exhaust gas escape porting extending generally axially from said third chamber and communicating with the exterior via radially directed outlets, e. and a sleeve supported on the housing for rotation and progressive axial displacement in progressively closing relation with said outlets to selectively and variably control the escape of exhaust gas therefrom, said sleeve having threading connected with threading on the housing to provide said progressive axial displacement in response to said rotation of the sleeve relative to the housing.

2. The structure as defined in claim 1 wherein the shaft is directly exposed to the third exhaust chamber.

3. The structure as defined in claim 1 including first and second bearings supporting the shaft, the rotor chamber and said third exhaust chamber extending between said bearings.

4. The structure as defined in claims 1 including a shaft bearing located radially inwardly of said additional escape porting.

5. The structure as defined in claim 1 wherein said first exhaust chamber has internal walls with radial spacing therebetween which varies about the rotor chamber, and said primary ports are spaced about the rotor chamber to communicate different radially dimensioned portions of the first exhaust chamber with the second exhaust chamber functioning as a plenum chamber.

6. The structure of claim 1 including axially spaced slots communicating between the rotor chamber interior and said first exhaust chamber.

7. The structure of claim 6 wherein said slots have means to produce a gradual escaping gas pulse pressure rise as each vane passes over said means.

* * * * *